US005510167A

United States Patent [19]

Candolfi et al.

[11] Patent Number: 5,510,167

[45] Date of Patent: Apr. 23, 1996

[54] UNIVERSAL COVER FOR ARMCHAIRS, SOFAS, AND THE LIKE

[75] Inventors: Francesco M. Candolfi, Filottrano; Claudio DeFelice, Treia, both of Italy

[73] Assignee: Caleffi - S.p.A., Mantova, Italy

[21] Appl. No.: 957,737

[22] Filed: Oct. 7, 1992

[30] Foreign Application Priority Data

Oct. 11, 1991 [IT] Italy ..... AN91U0025

[51] Int. Cl.[6] ..... B32B 5/12

[52] U.S. Cl. ..... 428/107; 428/113; 428/231; 428/232; 150/158

[58] Field of Search ..... 428/231, 230, 428/107, 113; 150/158

[56] References Cited

U.S. PATENT DOCUMENTS

| | | | |
|---|---|---|---|
| 2,134,630 | 10/1938 | White | 2/67 |
| 2,793,683 | 5/1957 | Trubitt | 155/182 |
| 3,371,668 | 3/1968 | Johnson | 428/231 |
| 4,413,623 | 11/1983 | Pieniak | 604/365 |
| 4,694,511 | 9/1987 | Estes et al. | 2/69 |

FOREIGN PATENT DOCUMENTS

| | | |
|---|---|---|
| 815326 | 7/1937 | France . |
| 523046 | 5/1972 | Switzerland . |

*Primary Examiner*—Christopher W. Raimund
*Attorney, Agent, or Firm*—Knobbe, Martens, Olson & Bear

[57] ABSTRACT

A cover is disclosed which is formed from a non-elasticized cloth provided with stitchings of elastic yarns stretched across the cloth back and attached thereto to form a quadrilateral mesh net.

8 Claims, 3 Drawing Sheets

FIG.1
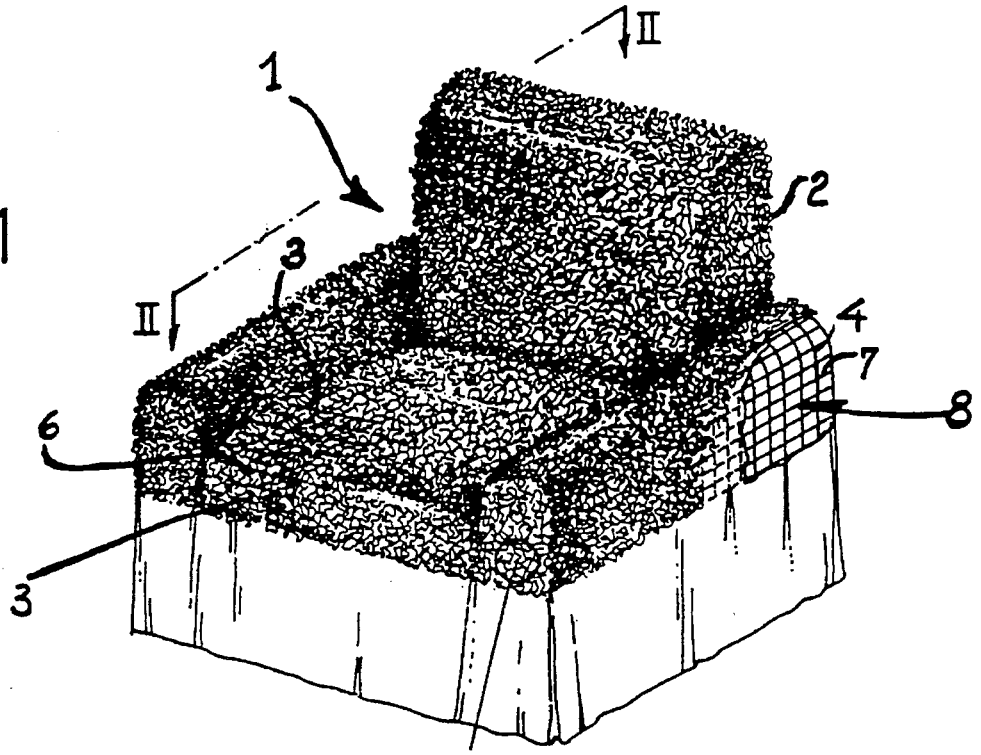
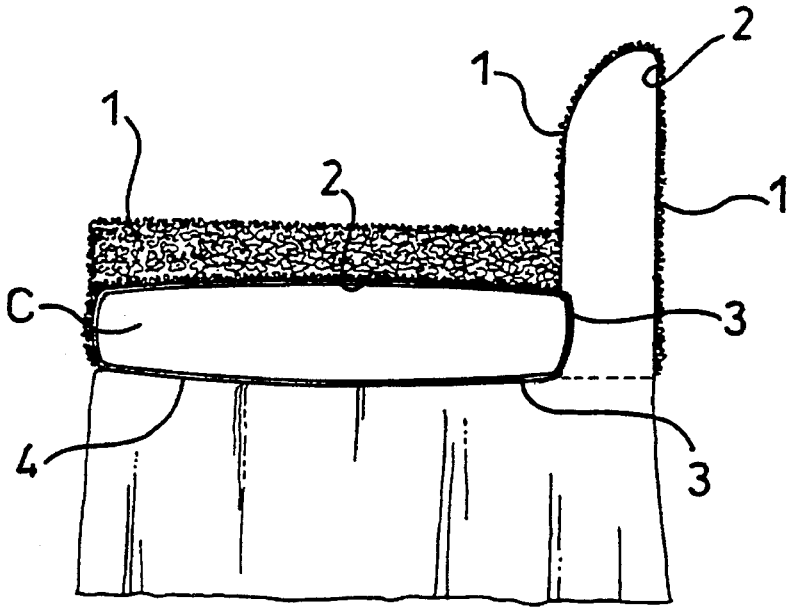
FIG.2

UNIVERSAL COVER FOR ARMCHAIRS, SOFAS, AND THE LIKE

This invention relates to a cover for armchairs, sofas, and the like, and more particularly a cover as above which is formed from non-elasticized cloth.

As is known, a frequent expedient with owners of armchairs, sofas, and the like covered items of furniture, is that of covering them with cloth covers wherever the original covers show signs of wear or merely to change or renew their looks as desired.

Heretofore, to fulfill this requirement, there have been made available but two types of covers: "tailored" ones, that is covers purposely made of non-elasticized cloth cut to fit armchairs or sofas to be covered exactly, and so-called "universal" ones, usually made of elasticized cloth which can be readily adapted to armchairs and sofas varying in size and design.

While widely used and even satisfactory under certain aspects, both cover types have non-negligible disadvantages. In fact, tailored covers made of non-elasticized cloths generally afford considerable aesthetic benefits as regards style and fit, but are characterized by a fairly high cost due to the specific and accurate processing, comparable to couture methods, that their manufacture involves.

Elasticized cloth covers are definitely less expensive than the former, but have a well recognized disadvantage in their cheap appearance, due indeed to the nature of the cloth they are made of, as well as in their occasional inability to fit closely around different design and size armchairs and sofas.

To overcome the deficiencies of the prior art, a primary object of this invention is to provide a cover for armchairs, sofas, and the like, having such features as to make it universal from the standpoint of its applicability, while being formed from a non-elasticized cloth, and which can combine the qualities of the two cover types mentioned above as to style and low-cost manufacture, on the one side, and enhance the overall appearance of an object to which it has been applied in a unique and unexpected way, on the other side.

This and other objects to become apparent hereinafter are achieved by a cover for armchairs, sofas, and the like items of furniture, being characterized in that it is formed from a non-elasticized cloth having at least a first plurality of parallel stitchings of elastic yarns stretched across the cloth back and tied to respective conventional yarns, and at least a second plurality of like stitchings, lying transverse to the former, the elastic yarns of said stitchings forming a quadrilateral mesh net.

The cover of this invention can fit around armchairs and sofas to different designs and sizes, and yet be made of a non-elasticized cloth. It can, therefore, be related to the universal covers, despite the improved aesthetic quality that this cloth can afford.

The cover of this invention is formed from a non-elasticized cloth cut to such size and shape as to cover the largest of armchairs and sofas; subsequently, a quadrilateral mesh net of stretched elastic yarns is formed over said cloth using a conventional method. The net is made up of said two pluralities of stitchings enabling the cover to become stretched by elastic deformation, and then shrink back elastically of its own accord. Thus, by virtue of this feature, the cover can be first "spread" or stretched over an armchair, and then released to allow it to shrink back elastically with some force around the armchair.

In the fully relaxed condition of the net, the cover of this invention has an embossed, densely ribbed appearance, since the mesh pattern tends to gather in the cloth. The densely embossed appearance of this initial condition will tend to thin out as the cloth is being stretched over larger size armchairs or sofas until it disappears altogether upon the cover attaining a condition of fully stretched net/cloth, when it covers well largest size sofas and armchairs.

Besides the "initial" condition with the net almost completely relaxed and the "end" condition with the net fully stretched, in all the other intermediate conditions the cover of this invention can still be made to fit in the best of manners closely around all the parts of an armchair or sofa. And this by virtue of the elastic yarn net imparting to all the cover portions an ability to shrink along two different directions.

Additionally, associated with this cover, beneath its seating portion, is a pouch which can accommodate a cushion or some like padding.

The weight and size of said cushion will subject nearly all the cover cloth portions to a powerful and permanent pull directed to the middle of the armchair or sofa along backrest-to-seat and/or armrest-to-seat directions. This pull is always adequate to ensure a perfect fit of the cover around the armchair (or sofa) even in most critical areas of its surface.

As for the construction of a cover according to the invention, the various parts intended to cover the armrests, backrest, and seat of a sofa or armchair to be covered are first cut after one another from a piece of non-elasticized cloth; thereafter, all these cloth parts are individually quilted, in the manner previously described, with elastic yarns, and finally sewn together into the complete cover.

The features and advantages of the invention will be more clearly apparent from the following detailed description of an embodiment of a cover according to the invention, given with reference to the accompanying exemplary and non-limitative drawings, in which:

FIG. 1 is a perspective view of a cover according to the invention as applied to an armchair, with some parts omitted to gain a better view of the cover construction;

FIG. 2 is a sectional view taken along line II—II in FIG. 1, with the constructional details of the armchair omitted;

Figure 3:
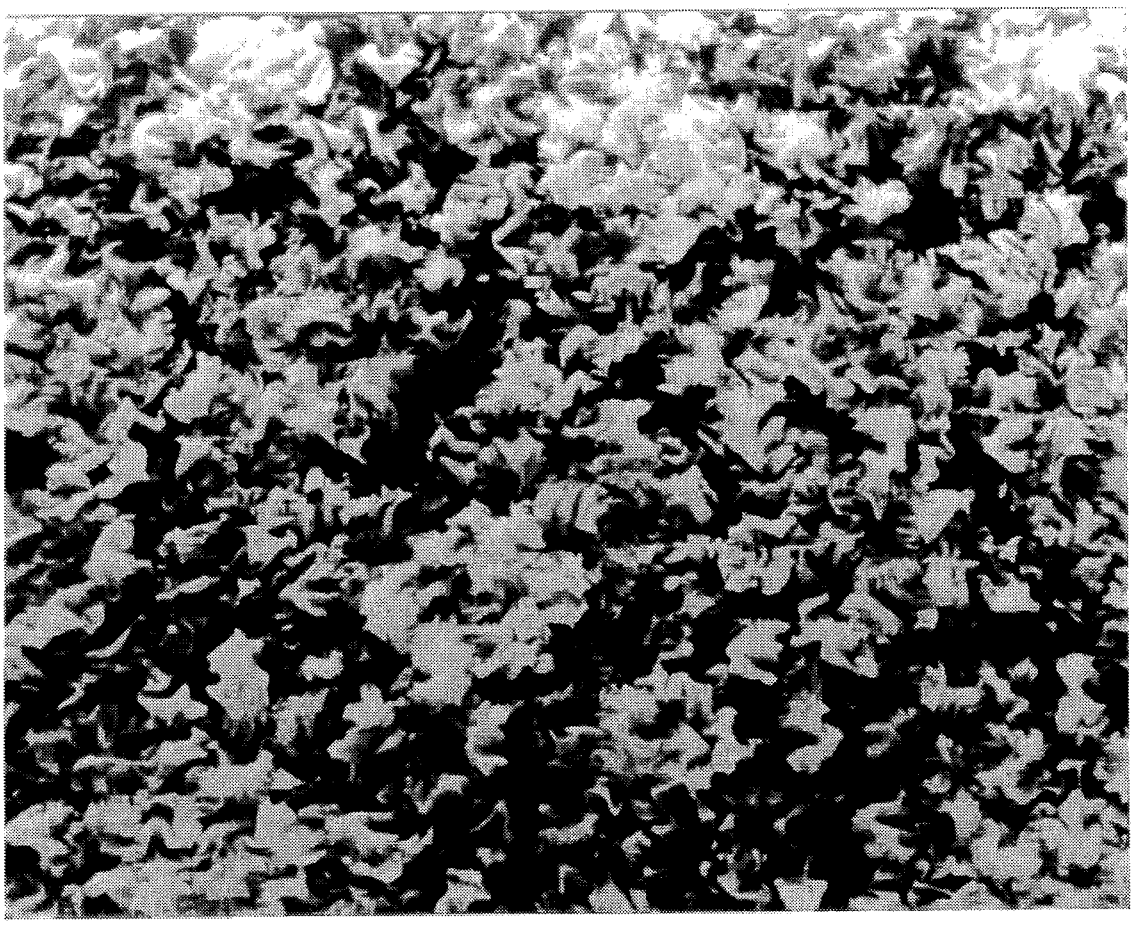
FIG. 3 is an enlarged detail view of the exposed surface of the cover in FIG. 1.

With reference to the drawing views, generally shown at 1 is a cover according to the invention which is structured and shaped to fit around an armchair.

Figure 4:
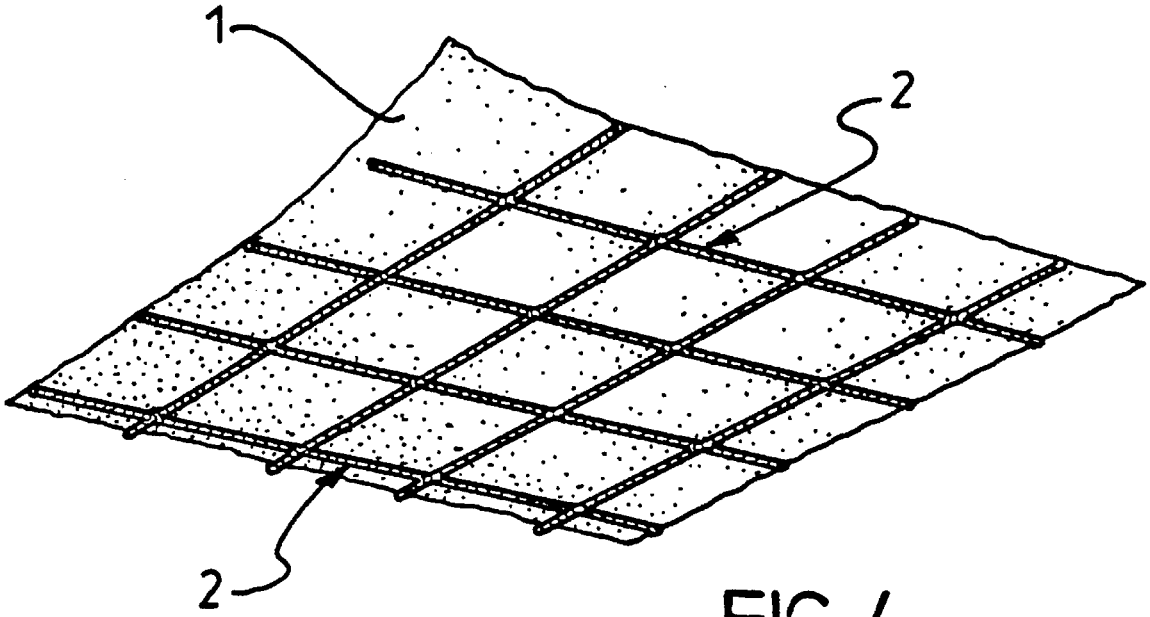
FIG. 4 is an enlarged bottom view showing schematically a cloth portion of the cover in FIG. 1 in the fully stretched condition thereof.

Said cover 1 is formed from a non-elasticized cloth 2 having a first plurality of parallel stitchings obtained with a corresponding plurality of elastic yarns 4 stretched across the back of said cloth 2 and conventional tying yarns. A second plurality of similar stitchings 6 have respective elastic yarns 7 laid crosswise to the elastic yarns 4 of the first plurality of stitchings to form a quadrilateral mesh net 8 therewith. In a preferred, but not limitative, embodiment, said mesh is square in shape with a side length of about 4 cm in the fully stretched condition (FIG. 4) of the elastic yarns (and hence of the net 8), and of about 1 cm in the fully relaxed condition thereof. In the last-mentioned condition, the mesh of said net 8 will gather in the cloth imparting a densely embossed appearance to it (FIG. 3) which is to be much appreciated from the aesthetic point of view. This embossed appearance is retained, albeit in a progressively thinning way, as the net 8 and cloth 2 are stretched around armchairs of increasingly larger size.

The cover 1 of this invention is provided, at the location of the first seating area thereof, with a pouch 9 adapted to accommodate a seat cushion 10 for the armchair to which said cover is to be applied.

Preferably, said pouch 9, being generally square or rectangular in shape, is sewn onto the back of the cover 1 seat, along the rearward edge and the side edges thereof lying parallel to the armchair armrests, and is open at the front to receive the cushion 10, said open side being closeable by conventional means, such as ties or adhesive strips A further advantage of the inventive cover is that, by the provision of the elastic yarn net, it can prevent the formation of "impressions" in its exposed surface, even after reiterate and prolonged use by the heaviest of persons.

In fact, as the person stands up from the armchair, the cloth will revert elastically to its original embossed appearance.

We claim:

1. A cover for an article of furniture comprising a plurality of pieces of non-elasticized cloth each of said pieces having at least a first and a second set of parallel elastic yarns stretched across the cloth back and attached to said back, wherein the second set of yarns is disposed transversely to the first set of yarns to form a quadrilateral mesh net, the yarns being attached to the back under tension so that when the yarns are in a relaxed state the cloth will have an embossed appearance, wherein each of said pieces of the cover is adapted to fit a particular component of said furniture, said components being selected from the group consisting of armrests, backrest and seat of said furniture, and wherein said pieces of the cover are attached together in the shape of said components of the article of furniture intended to be covered.

2. A cover as claimed in claim 1, wherein the stretching of said elastic yarns is sufficient to gather said cloth when said yarn is in its fully relaxed condition, so as to impart a densely embossed appearance to said cloth.

3. A cover as claimed in claim 1, wherein said first and second sets of elastic yarns are disposed perpendicular to one another, to form a square mesh.

4. A cover as claimed in claim 3, wherein said squares have a side length of about 4 cm in the fully stretched condition of said elastic yarns and of about 1 cm in the fully relaxed condition of said elastic yarns.

5. A cover as claimed in claim 1, having a portion adapted to cover the seating area of a sofa or armchair, said portion having a pouch for accommodating a cushion or similar seating padding.

6. A cover as claimed in claim 5, wherein said pouch is sewn onto the back of said cloth.

7. A cover as claimed in claim 5, wherein said pouch comprises an opening for receiving said cushion or padding and is arranged so that, when placed on a sofa or armchair, said opening faces forwardly.

8. A cover as claimed in claim 1, wherein said pieces of cloth having said quadrilateral mesh net of elastic yarns attached to their backs are sewn together to form said cover.

* * * * *